US011198292B2

(12) United States Patent
Ungerer et al.

(10) Patent No.: US 11,198,292 B2
(45) Date of Patent: Dec. 14, 2021

(54) PRINT HEAD AND PRINTING METHOD

(71) Applicant: Karlsruher Institut fuer Technologie, Karlsruhe (DE)

(72) Inventors: Martin Ungerer, Pforzheim (DE); Andreas Hofmann, Karlsruhe (DE); Rudolf Scharnowell, Karlsdorf-Neuthard (DE); Ulrich Gengenbach, Remchingen (DE); Ingo Sieber, Karlsruhe (DE); Achim Wenka, Remchingen (DE)

(73) Assignee: KARLSRUHER INSTITUTE FUER TECHNOLOGIE, Karlsruhe (DE)

( * ) Notice: Subject to any disclaimer, the term of this patent is extended or adjusted under 35 U.S.C. 154(b) by 0 days.

(21) Appl. No.: 16/968,623

(22) PCT Filed: Feb. 8, 2019

(86) PCT No.: PCT/EP2019/000036
§ 371 (c)(1),
(2) Date: Aug. 10, 2020

(87) PCT Pub. No.: WO2019/154558
PCT Pub. Date: Aug. 15, 2019

(65) Prior Publication Data

US 2021/0046754 A1 Feb. 18, 2021

(30) Foreign Application Priority Data

Feb. 12, 2018 (DE) ..... 10 2018 103 049.5

(51) Int. Cl.
*B41J 2/11* (2006.01)

(52) U.S. Cl.
CPC ..... *B41J 2/11* (2013.01)

(58) Field of Classification Search
CPC ..... B41J 2/17553; B41J 2/17523; B41J 2/17509; B41J 2/17513; B41J 2/17503;
(Continued)

(56) References Cited

U.S. PATENT DOCUMENTS 3,596,275 A 7/1971 Sweet
3,878,519 A 4/1975 Eaton
(Continued)

FOREIGN PATENT DOCUMENTS

DE 4128590 A1 3/1993
EP 0107467 A2 5/1984
(Continued)

OTHER PUBLICATIONS

US 5,828,388 A, 10/1998, Cleary et al. (withdrawn)

*Primary Examiner* — Kristal Feggins
(74) *Attorney, Agent, or Firm* — Leydig, Voit & Mayer, Ltd.

(57) ABSTRACT

A print head includes a capillary around an axis of symmetry for a liquid to be printed, the capillary adjoining at least one elastic element and having a nozzle opening which opens into a prechamber. The prechamber has an outlet opening aligned with the nozzle opening of the capillary in its axial orientation of the axis of symmetry and at least one inlet opening for a guide gas. The at least one elastic element forms a guide for the capillary in its axial orientation only. A feed for the liquid to be printed is provided in the capillary. A mechanical oscillation system is provided that includes the at least one elastic element and the capillary with the liquid contained therein. An actuator with a mechanical or magnetic force interaction with the oscillation system is further provided.

20 Claims, 6 Drawing Sheets

(58) Field of Classification Search
CPC ..... B41J 2/17566; B41J 2/17596; B41J 2002/17573; B41J 2/11; B41J 2202/02; B41J 2/025; B41J 2/18; B41J 29/02; B41J 29/13; B01L 2400/0439; B01L 2300/123; B01L 2400/0406; B01L 3/0268; B05B 7/045; B05B 7/2483; B05B 1/083
See application file for complete search history.

(56) References Cited

U.S. PATENT DOCUMENTS

| | | | |
|---|---|---|---|
| 4,240,081 | A | 12/1980 | Devitt |
| 6,460,980 | B1 | 10/2002 | Florian et al. |
| 7,095,018 | B2 | 8/2006 | Barnes et al. |
| 7,270,844 | B2 | 9/2007 | Giridharan et al. |
| 7,467,751 | B2 | 12/2008 | Lagally et al. |
| 9,114,409 | B2 | 8/2015 | King et al. |
| 2013/0321533 | A1 | 12/2013 | Conedera et al. |
| 2014/0009523 | A1 | 1/2014 | Katerberg et al. |
| 2015/0321468 | A1 | 11/2015 | Harada et al. |

FOREIGN PATENT DOCUMENTS

| | | | |
|---|---|---|---|
| EP | 0417285 | A1 | 3/1991 |
| EP | 1830927 | B1 | 3/2016 |
| JP | S5625465 | A | 3/1981 |
| JP | S56133173 | A | 10/1981 |
| JP | S5734971 | A | 2/1982 |
| JP | H01108053 | A | 4/1989 |

PRINT HEAD AND PRINTING METHOD

CROSS REFERENCE TO RELATED APPLICATIONS

This application is a U.S. National Phase Application under 35 U.S.C. § 371 of International Application No. PCT/EP2019/000036, filed on Feb. 8, 2019, and claims benefit to German Patent Application No. DE 10 2018 103 049.5, filed on Feb. 12, 2018. The International Application was published in German on Aug. 15, 2019 as WO 2019/154558 under PCT Article 21(2).

FIELD

The invention relates to a print head and a printing method.

BACKGROUND

Jet print heads are a central component in printing technology. They remove liquids (inks) from a reservoir, for example a cartridge, and accelerate them in the direction of a surface to be printed on for the printing process. Printing takes place in a metered way, i.e., the liquids are transported to the surface to be printed on only in individual drops. Various actuator and metering concepts are used for this purpose, e.g. using a piezoelectric, electrostatic or thermally acting principle. It is preferable to use what is known as the drop-on-demand technique, in which one or more drops are ejected only when a control signal is present. A quasi-continuous printing process, called the continuous drop method, is carried out by repeating the control signal, preferably with repetition frequencies greater than 1 kHz. Accordingly, various printing technologies are known which differ particularly in the function of the print head used, in particular the contactless piezo inkjet technique, the electrohydrodynamic inkjet technique, the aerosol jet technique, and the ultrasonic metering method in which the liquid to be printed enters into direct contact with the substrate to be printed on via a meniscus.

The print head mentioned at the outset is used particularly and preferably in the field of contactless digital inkjet printing methods for functional printing, i.e., printing of functional structures (e.g., strip conductors, resistors, capacitors, biological substances, etc.).

The piezo inkjet technique is the most widely used method. In this method, a piezo element acts on an ink volume in the printing nozzle, wherein a pressure or pressure pulse is exerted on the printing ink which results in at least one ink drop being ejected from the printing nozzle and sprayed onto the object to be printed on. Inks in a preferred viscosity range of between 5 and 40 mPa s are used for printing. A further viscosity range is covered in particular by the aerosol jet technique and the electrohydrodynamic inkjet technique, with the aerosol jet technique having the additional advantage of being able to print structures up to the one-digit mm range without vertically retracing the printing nozzle despite larger jumps in the topology of the surface to be printed.

An aerosol jet printing system and printing method for functional printing has been disclosed by the company Optomec Inc. (Albuquerque, N. Mex., USA) in U.S. Pat. No. 7,270,844 B2. Exemplary deposition head assemblies in this respect are described in EP 1 830 927 B1 and U.S. Pat. No. 9,114,409 B2. In this, an aerosol is guided in a sheath gas flow via a channel into a separate chamber and from there via a printing nozzle arrangement in the direction of an object to be printed on.

The disclosed aerosol jet printing method includes in particular production of an aerosol from ink, concentration of the aerosol, transport of the aerosol by gas to the printing nozzle arrangement, concentration of the aerosol, e.g. in the aforementioned chamber, and hydrodynamic focusing of the aerosol jet in the printing nozzle. The aerosol is produced either pneumatically or by ultrasound in the separate chamber of the print head. The aerosol produced is conveyed to the printing nozzle by means of a transport gas via tube systems and is bundled there by means of a focusing gas (likewise a sheath flow). The operating mode of the system cannot be changed. Before the actual printing process, the aerosol jet is adapted to the particular conditions by adjustment of various parameters (in particular volume flow of the transport gas, volume flow of the focusing gas, choice of nozzle and atomizer, etc.). Printing can begin as soon as the aerosol jet is stable. The aerosol volume flow remains constant throughout the entire printing process, the jet intensity is not regulated and is not varied. The metered quantity per unit time is therefore constant. In order to realize interruptions in the printed image, the aerosol jet must be interrupted after the nozzle. This is done by a mechanical ink capture device positioned between the nozzle and the substrate.

A disadvantage of the aforementioned method is that the print head must in principle be aligned with Earth's gravitational field and thus cannot be oriented arbitrarily to the surface to be printed on without additional measures, such as mechanical decoupling of the chamber for aerosol production and the nozzle. This local separation into a plurality of subsystems requires a tube system for conveying the aerosol flow to the printing nozzle. This increases the dead volume. In addition, long tubes may influence the aerosol (e.g., drop size change by agglomeration and aggregation of small drops, deposits of drops on the walls). The tube systems are then contaminated with a substance and must be cleaned or replaced if another fluid is to be printed without contamination.

A further limitation results from the structure of the print head as determined by the system. Full cleaning or interim cleaning (for example, if the liquids to be printed are changed) is made more difficult in particular because the apparatus separates aerosol production and printing nozzle and is thus more complex than for example a comparable inkjet printing system.

U.S. Pat. No. 7,467,751 B2 and U.S. Pat. No. 7,095,018 B2 disclose an ultrasonic plotting system and printing method by the company Sonoplot Inc. (Middleton, Wis., USA) as representative of an ultrasonic metering method.

As in the aforesaid aerosol jet printing system, the need for separate subsystems for conveying the fluid to be printed is also a limitation for the aforementioned ultrasonic metering method.

SUMMARY

In an embodiment, the present invention provides a print head. The print head includes a capillary around an axis of symmetry for a liquid to be printed, the capillary adjoining at least one elastic element and having a nozzle opening which opens into a prechamber. The prechamber has an outlet opening aligned with the nozzle opening of the capillary in its axial orientation of the axis of symmetry and at least one inlet opening for a guide gas. The at least one elastic element forms a guide for the capillary in its axial orientation only. A feed for the liquid to be printed is provided in the capillary. A mechanical oscillation system is provided that includes the at least one elastic element and the capillary with the liquid contained therein. An actuator with a mechanical or magnetic force interaction with the oscillation system is further provided.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
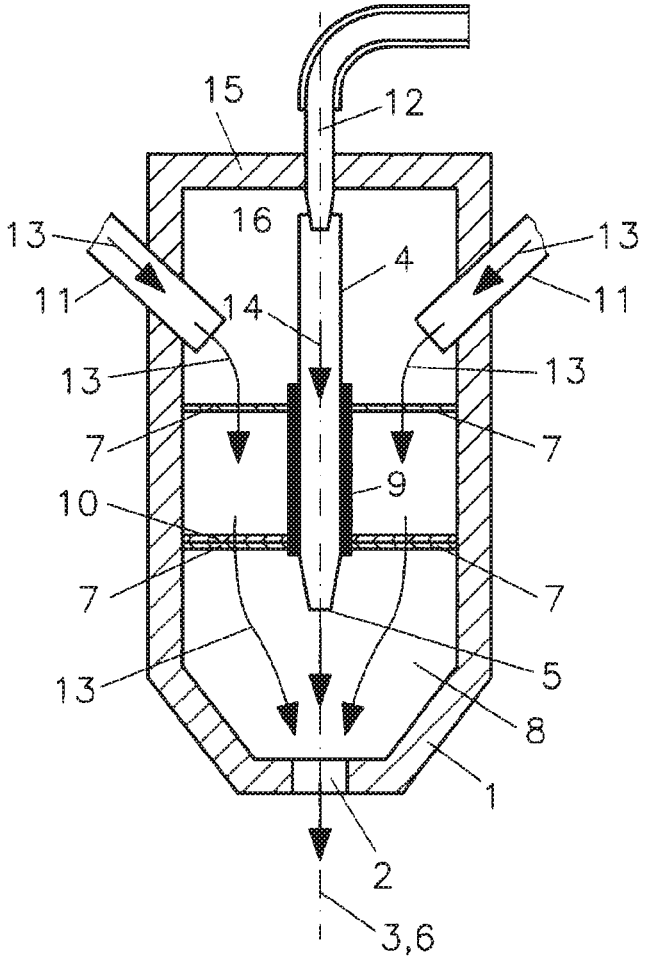
FIGS. 1*a* and 1*b* each show a schematic sectional view of a print head.

A particular challenge when using the technologies cited above is printing three-dimensional structures onto the surface of a substrate. For this type of printing, single- or multi-axial relative movements between the print head and the substrate must be enabled, for example by means of an electromechanical positioning system. With each change of direction, axial accelerations and decelerations occur and are absorbed by the print head. If the printing process takes place simultaneously with one of the above-mentioned axial accelerations and decelerations, as is the case with a constant aerosol volume flow, the amount of ink applied to the substrate necessarily varies with each impressed change. The properties of the printed structure (e.g., resistance of a printed electrode) are dependent on their geometry (e.g., direction changes, radii, lengths, topography, etc.) in, for example, the cited aerosol jet printing system.

The cited aerosol jet printing system and printing method for functional printing does not disclose a solution to the aforesaid problem since the process of aerosol production is designed for a constant aerosol mass flow and neither repeated interruptions during the printing process nor regulation of the aerosol mass flow are provided. A simple switch between different fluids in a print head is likewise not provided.

The cited prior art with regard to the ultrasonic metering method does not present any possibility of printing the aforementioned structures in a contactless manner. The method described therein requires precise distance control between nozzle and substrate and is suitable only for planar substrates, such as silicon wafers.

Starting therefrom, the present disclosure provides an improved jet print head in such a way that the aforementioned limitations and disadvantages as well as their effects are avoided or reduced.

In particular, the present disclosure provides a jet print head which is suitable for printing even three-dimensional structures of the type mentioned at the outset.

The present disclosure further provides a jet print head which can be changed more quickly in comparison to conventional systems while avoiding cross-contamination and/or liquid carryover of the liquids to be printed into the printing system.

The present disclosure further provides a corresponding printing method, in particular for printing structures, preferably functional structures, onto a surface using the jet print head.

The advantageous embodiments each have features which, within the scope of the invention, can each also be combined, individually or in any desired combination, with any other of the embodiments.

The disclosure is based on a print head comprising a capillary for a liquid as the printing fluid with a nozzle opening which opens into a prechamber. The capillary directly or indirectly via further components, such as an elastic element and/or fastening means for the capillary (e.g. clamping means), adjoins an actuator, i.e., it is in solid contact therewith. The piezo actuator is preferably connected to the capillary in a fixed manner. Said prechamber furthermore has an outlet opening aligned with the nozzle opening of the capillary, i.e., the axes of symmetry of the capillary and the outlet opening preferably coincide. Furthermore provided are inlet openings, opening into the prechamber, for a guide gas, which leaves the prechamber together with the printing fluid via the outlet opening in the direction of a surface to be printed on.

The actuator is preferably a piezo actuator. Alternatively, especially for larger print head embodiments, electromechanical actuators or, especially in the case of very small designs, electrostatic actuators are also suitable as actuators.

In further embodiments, the actuator is composed of a plurality of components, also including passive components.

Passive components comprise, for example, at least one elastic element, at least one elastic plate spring element and/or at least one elastic bending element or bending strip as a connecting component between the capillary and the print head housing. They serve in particular for guiding the capillary and preferably permit the capillary to undergo only one unidirectional axial motion that is elastically flexible around a basic position in the print head housing. Passive components preferably also comprise a lever mechanism between an active component of the actuator, for example a piezoelectric transducer (piezo actuator), which active component is preferably in contact with the passive components, more preferably can be mechanical triggered by them.

The present disclosure proposes that the liquid from the capillary is first atomized directly at the nozzle opening by an axial oscillating movement of a capillary and forms an aerosol with the guide gas. The aerosol is thus not guided into the prechamber in a preconditioned form but is advantageously formed in the prechamber at as late a time as possible only shortly before the printing process.

The capillary, preferably a glass capillary, is connected to at least one reservoir, preferably at least one cartridge for the liquid (printing fluid). The capillary thus has non-continuous or preferably continuously conveying feed means for the printing fluid into the capillary, preferably at the end of the capillary (proximal end of the capillary) opposite the nozzle opening (distal end of the capillary). This preferably takes place by means of a supply line either in a contactless manner to the capillary, for example through an outlet opening of the supply line protruding into said proximal end of the capillaries, or by means of an elastic tube connection preferably between the proximal end of the capillary and said outlet opening of the supply line. The supply line represents a connection between at least one reservoir of the fluid to be printed and the capillary. The fluid is preferably conveyed capillarily, i.e., fluid losses in the capillary via the nozzle opening during the printing process are compensated for by capillary suction of fluid components. However, one embodiment provides for the supply line to be provided with its own active fluid conveying means (feed pump). Another optional embodiment comprises at least one mixing chamber for mixing or homogenizing fluid components, e.g. from different reservoirs and combined in the mixing chamber. Said mixing chamber can be located functionally in the capillary and to provide a separate supply line directly into the capillary for each involved reservoir.

The capillary is preferably connected to the supply line via a preferably flexible tube for better mobility of the print head and to reduce the movable masses required during a positioning movement of the print head. The liquid is transported via the tube through the capillary and the nozzle opening into the prechamber. Transport (conveyance) takes place preferably, i.e., not necessarily, without a feed pump.

The at least one inlet opening for the guide gas is preferably arranged to the side of the capillary. The orientation of the at least one inlet opening and thus the inlet opening is additionally preferably oriented toward the outlet opening at an acute angle to the axis of symmetry of the capillary, i.e., the orientation is vectorially composed of a vector oriented orthogonally to and a vector oriented in parallel to the axis of symmetry, with the parallel partial vector pointing in the direction of the outlet opening as seen from the nozzle opening.

In a preferred embodiment, said orientation intersects the axis of symmetry of the capillary inside the prechamber. If the fluid to be printed from the capillary is a liquid or a suspension and emerges from the nozzle opening as an injected jet, this jet crosses the stream of the guide gas. Aerosol formation occurs upon collision.

An essential feature relates to the arrangement of the actuator in the print head, its arrangement with respect to the capillary and the configuration of the actuator movement. The actuator is preferably inserted in a fixed manner in the prechamber of the print head, more preferably opposite to the outlet opening. The actuator movement serves to move the capillary relative to the prechamber and comprises preferably only axial back and forth movements with respect to the axis of symmetry of the capillary and outlet opening. Aside from the design and direction of action of the actuator, the actuator movement is also determined by the fixing points, i.e., the fastening points of the actuator in the print head on the one hand, and by the arrangement of the receptacle for the capillary on, in or above the actuator away from the fixing points on the other hand. The fastening for fixing the piezo actuator in the prechamber is preferably done by means of adhesive bonding, clamping or screwing.

If the actuator, preferably a piezo actuator, is designed as an oscillating actuator, preferably an oscillating actuator that can be operated in resonance, it preferably comprises a plate-, disk-, ring-, cross- or bar-shaped oscillating bending actuator, at least one preferably annular translation actuator or one or more oscillating shear actuators with a receptacle for the capillary preferably arranged centrally on the actuator. The oscillating bending actuator and the aforementioned fastening points (fixing points) extend to the prechamber symmetrically, preferably rotationally symmetrically, around the receptacle and thus around the axis of symmetry of the capillary and the outlet opening. A preferred embodiment provides for the fastening points to be designed as fixed supports for the oscillating actuators in order to achieve the highest possible oscillation amplitudes. A piezo oscillating bending actuator, which is preferably elastically fixed at both ends, preferably reaches its maximum amplitude at its center. They are preferably formed by at least two individual points or, in particular in the case of a plate- or disk-shaped oscillating bending actuator, by support lines. If an actuator is preferably clamped so as to be fixed in place on only one side, the maximum amplitude is reached at the respective other end.

An alternative embodiment of the piezo actuator comprises a stack of layers of disk-shaped individual piezo actuators, the deflections of which add up to a total deflection. Alternatively, what are called D31 transducers or shear actuators can also be used whose actuator movement can be tapped transversely to the applied electric field and is used for the axial movement of the capillary. Compared to an oscillating bending actuator, these embodiments are significantly stiffer and are particularly suitable for non-resonant guided actuator movements, for example for rectangular oscillations or sawtooth-shaped oscillations or individual jolting movements.

The capillary is moved axially back and forth by the piezo actuator, preferably in an oscillating manner, and is guided either in resonance or following a predeterminable, preferably cyclic curve (oscillation curve, e.g. sawtooth, rectangular shape, etc.). The capillary and therefore also its nozzle opening are thus moved forward and backward in each movement cycle, with an acceleration acting on the capillary and nozzle opening and thus also on the printing fluid located in the nozzle opening during each change of direction, deceleration or jerk. If the nozzle opening is accelerated during retraction, i.e., by a change in direction toward the distal direction, i.e., toward the outlet opening, the inertia of the printing fluid alone causes fluid components to be pressed out of the nozzle opening and drops or other fluid components to be separated out, in particular at the nozzle exit face of the capillary wall. On each oscillation cycle, drops of the printing fluid thus separate from the nozzle opening and are received by the guide gas. The parts of the guide gas and the separated components of the printing fluid form an aerosol which is conducted from the prechamber via the outlet opening to the surface to be printed on. Printing occurs immediately after aerosol formation, with the result that the risk of demixing is advantageously reduced.

The aligned placement of nozzle opening and outlet opening is particularly advantageous especially for the aforesaid process, since due to their velocity and inertia during separation, the separating drops not only form an aerosol but also exert a momentum on the aerosol flow in the direction of the outlet opening and thus of the surface to be printed on. The aerosol flow velocity is already high at the nozzle outlet. The aerosol flow is focused in the direction of the center of the jet by the guide gas flow, which initially forms around the aerosol flow, preferably as a sheath flow, and at least partially also mixes in the prechamber toward the outlet opening. It is advantageous here that the drops contribute substantially to the total momentum of the aerosol because of their substantially higher density in comparison to the guide gas.

When the aerosol is being formed as stated above, preferably only a portion of the guide gas flow is transferred into the aerosol, i.e., it receives the separated drops. However, the remaining portion of the guide gas flow, together with the aerosol flow formed, leaves the prechamber via the outlet opening. Since the aerosol flow is concentrated around the axis of symmetry of the capillary and thus of the outlet opening due to the aforesaid momentum observation, the remaining portion of the sheath gas flow is displaced into the edge regions of the outlet opening and thus forms a sheath flow around the aerosol flow. This sheath flow reduces the contact between the aerosol and the inner wall of the outlet opening, and thereby reduces accumulation of aerosol components and advantageously also clogging of the outlet opening by the printing fluid.

The mass flow of the aerosol can be regulated, preferably by changing the process parameters of fluid pressure in the capillary, by the voltage amplitude and frequency during activation of the actuator, and by changing the activation signal, for example from a sine function to another periodic function (e.g. sawtooth shape, rectangular shape) or by superposition of a phase-shifted periodic signal.

The mass flow of separated drops and thus also the speed of the ongoing separation and atomization of the liquid, i.e., of the printing fluid at the nozzle opening, can be adjusted and regulated by means of the amplitude of the axial backward and forward movement. At a constant frequency, the mass flow in particular but also the drop size of separated drops and thus also the aerosol properties can be adjusted using the amplitude height.

The frequency of the axial backward and forward movement makes it possible to adjust in particular the size of the separated drops, an essential feature for an aerosol that is forming. The frequency is preferably between 50 kHz and 2 MHz. Furthermore, the scattering range of the separated drops, which extends conically around the axis of symmetry, can be enlarged by lateral harmonic frequencies superimposed on the fundamental oscillation.

A design of the nozzle opening, especially its diameter, of a sharp-edged capillary edge of the capillary produced by a breaking edge also allows the aforesaid scattering range of the separated droplets that extends conically around the axis of symmetry to be preset. Likewise, a capillary edge that extends on a non-orthogonal to the capillary axis enables a preferred direction of deflection of the separated drops.

The behavior of the aerosol production can be controlled by the aforementioned process parameters. In the final installation state, these parameters reduce to the following main influencing factors: frequency, mode of oscillation, amplitude, fluid pressure. If activation of the piezo element is switched off, aerosol production is interrupted. No more liquid is ejected from the nozzle (either in aerosol form or in any other form). If an interruption in the printed image is needed, this binary behavior is used to switch off the aerosol jet without requiring a mechanical ink catcher.

A change in the individual parameters of frequency, mode of oscillation, amplitude and fluid pressure or a combination of these parameters leads to a change in the mass flow of the aerosol (liquid) leaving the nozzle opening and thus the outlet opening, as a result of which the influence of accelerations of the axes of the printing system on the homogeneity of the printed image (homogeneity of the printed structures) can be compensated for.

The capillary preferably adjoins a piezo actuator, i.e., it is in solid contact therewith. In such an embodiment, the piezo actuator has a receptacle for the capillary. The receptacle connects to the capillary and also undergoes the same axially oscillating or vibrating movements preferably imposed by the piezo actuator. They form a common oscillation system. If the capillary is oscillating in resonance, the receptacle acts as part of the oscillating mass on the oscillating actuator.

For this purpose, an embodiment of the receptacle provides for the piezo actuator of the print head to be designed preferably with clamping means in which the capillary is clamped in a force-fitting manner. These means preferably consist of a bore in the actuator or of a preferably elastic component which is mounted or inserted on the actuator and which preferably forms, together with the piezo actuator, a transition fit, preferably with a push fit (according to *Dubbel: Taschenbuch für den Maschinenbau*, Springer Verlag, 14th edition (1981) p. 339). Compared to snug transition fits or press fits, manual replacement of the capillary in the print head is still possible without additional pressing or striking tools and without risk of damage to the glass capillary. An alternative embodiment provides a clamping means configured with an elastic clamping element, such as a spring element, wherein the clamping means presses the capillary on the piezo actuator onto a counter-surface defining the capillary orientation, said counter-surface preferably having a guide groove or a stop for the capillary, and fixes it axially through force-fitting and/or frictional engagement. In addition, in the above-mentioned embodiments, the capillary, in particular a glass capillary, advantageously has an optional tubular sheath which encloses the capillary and is fixedly attached thereto (e.g. adhesively bonded or pressed) and which is further preferably limited in length to the clamping region of the gripping clamping means, which is significantly shorter than the capillary length.

In the context of the application in particular, a fundamental distinction is made between three basic mechanical connection types: a force-fitting, a substance-bonded, and a form-fitting connection, with mixed forms often being used. A force-fitting connection between two surfaces is characterized in that the surfaces are pressed against each other by a force, e.g. by clamping means, and adhesive friction which fixes the two surfaces to one another is generated solely by the surface pressure. An adhesive material transition, as occurs in the case of substance-bonded connections, for example in the case of welding, adhesive bonding or soldering of two surfaces, is not present in the case of a force-fitting connection. Distinct from these are form-fitting connections, in which topographies or supplementary elements between the two surfaces interlock, holding the surfaces together in this way. Examples of this are rivet connections between two metal sheets, a tongue and groove connection or elements that act against a counter-fit, such as steps, grooves, collars or ribs.

The aforementioned clamping means simplify replaceability within the print head. Replacing the capillary can implement, in particular, a change of the liquid to be printed but also of the scattering range of the separated drops substantially determined by the design of the nozzle opening. A further advantage of such a change of the printing medium and/or of the scattering range is ensured in that the aerosol is produced in the prechamber only when required (aerosol-on-demand) and only when the paste or the liquid leaves the nozzle opening. In this case, the sheath gas introduced into the prechamber via the inlet openings acts not only as an optional component of the aerosol which forms but in particular as a sheath flow around the aerosol, both in the prechamber and in the downstream outlet opening. This reduces the contact of the printing medium (paste or liquid) and the aerosol containing it with the inner walls of the prechamber and the outlet opening and significantly prevents contamination thereof. In the context of a printing process, this in turn makes it easier to change the liquid to be printed since no further cleaning processes are required except for a replacement of the capillary and the provided feed means for the liquid to be printed.

A further embodiment of the receptacle for the capillary provides for additionally providing a form-fitting design axially with respect to the axis of symmetry between capillary of the receptacle and the piezo actuator and/or an elastic element. Said design comprises, for example, steps or ribs which are fixedly connected to or formed integrally with the capillary and which engage axially and form-fittingly as a stop oriented to one or both sides with a design of the capillary receptacle or the clamping means which is provided as a counter-fit. Accordingly, it is appropriate to provide the aforementioned enveloping tubular sheath with circumferential grooves or collars or to use the end regions of the tubular sheath for form-fitting axial fixing in place. The particular advantage of this preferably additional embodiment is that, on the one hand, possible slipping processes between receptacle and capillary that have a damping effect on axial movement are prevented or reduced, and on the other hand, as a result of the form-fitting stop, the positioning of the capillary in the prechamber becomes reproducible in a simplified manner during replacement or installation of a capillary.

The paste or liquid conducted through the capillary is the material to be printed. It can be single-phase or polyphase, for example as a suspension. Polyphase components can also be provided which react with each other and are preferably taken from two or more separate reservoirs and are brought together between the reservoir and the nozzle opening and preferably also mixed or suspended there. Examples which may be mentioned here are multicomponent epoxy resins whose components are preferably mixed in the capillary as in other multicomponent systems, are conducted as a mixture via the nozzle opening into the prechamber and from there via the outlet opening to the surface to be printed on and harden only on the surface.

A further embodiment of the print head provides means for generating an electrostatic field orthogonal to the axis of symmetry at the outlet opening. This makes it possible to further manipulate, in particular deflect, focus, or further atomize the aerosol flow after an optional ionization. The means for this purpose preferably comprise electrodes in or around the outlet opening.

A further embodiment of the print head provides means for generating an electrostatic field parallel to or concentric to the axis of symmetry at the outlet opening. While the one electrode is arranged orthogonally to the axis of symmetry around the outlet opening, the second electrode is formed by an electrically conductive substrate to be printed as a whole or a part thereof or, in the case of an electrically non-conductive substrate (e.g., polymer films), by electrically conductive additional elements, such as an intermediate plate or intermediate layer in or below the substrate. Such an electrode arrangement preferably enables focusing on the substrate.

The present disclosure further provides a printing method for printing a structure, preferably a raised structure, onto a surface while using an aforementioned print head. In this case, a liquid or a paste is guided through the capillary through the nozzle opening into the prechamber, with the nozzle opening being moved back and forth by a piezo actuator and the liquid or the paste being continuously separated and atomized as fluid droplets at the nozzle opening. A guide gas is introduced into the prechamber around the capillary through the at least one inlet opening, wherein a first portion of the guide gas forms an aerosol flow with the fluid droplets in the prechamber and a second portion forms a sheath flow around the aerosol flow between the nozzle opening and the outlet opening. Here, the second portion is preferably larger than the first portion, wherein, in a particularly preferred embodiment, the first portion is absent or nearly zero (second portion above 95%). The aerosol flow surrounded and focused by the sheath flow is then guided through the outlet opening out of the prechamber onto a surface of a substrate, where the fluid droplets are applied to the surface.

Preferably, an oscillation system is formed from the oscillating actuator, the capillary with the liquid or paste contained therein and the receptacle for the capillary and, if applicable, further co-oscillating components (e.g., fluid connection); this oscillation system is furthermore preferably excited in a resonance oscillation.

The print head and the printing method described have the further following advantages:

1. The design-related low volume, and thus also the low unused dead volume (volumes in which liquid components in particular can accumulate and, in the worst case, can also settle for a long time) of the fluid-conducting components, enables low liquid losses during printing as well as better meterability and mixing settings even of lower liquid quantities.
2. Due to the short paths and times between aerosol formation and printing, elimination of larger drops or agglomerates of the liquid or homogenization of the aerosol is not required.
3. Complex guidance of the print head during the printing process is thus also made possible without mechanical decoupling of the aerosol production, in particular also overhead printing.
4. A reduction of the aerosol-guiding components and the aerosol guiding in the print head results in reduced contamination thereof with aerosol, which in turn significantly simplifies and accelerates changing the printing medium to be printed during the printing process.
5. No additional ink catcher or shutter is required at the outlet opening in order to create interruptions in the printed image. This is due to the binary behavior of the new aerosol production device (aerosol-on-demand).
6. An aerosol concentrator is no longer needed.
7. Cleaning the print head or changing it after changing the liquid to be printed is no longer necessary. It is sufficient to replace the capillary in the print head (as well as the fluid connection with ink cartridge outside the print head). These are inexpensive standard disposable components. This is due to the clamping device for glass capillaries of the new aerosol production device.
8. The aforesaid embodiments with short paths between nozzle opening and outlet opening as well as the sheath flow reduce the influence of gravitational forces during the printing process. By adapting the process parameters, it is thus also possible to print above the head without requiring mechanical separation of aerosol production and printing nozzle. This in turn facilitates a more compact design of the print head.

Thanks to a preferred clamping connection between the capillary and piezo element, replacing all fluid-conducting components, preferably in the form of disposable components, is simpler compared to the aforementioned prior art and therefore quicker and/or more economical. The otherwise often lengthy cleaning is reduced to a minimum due to the late aerosol formation, the small, generally short paths and thus correspondingly small surface and volume regions (including the aforementioned dead volumes) between the nozzle outlet and the outlet opening that can be contaminated with aerosol, and the aforementioned reduction of the risk of contamination in these surface regions brought about by the guide fluid, in particular as sheath flow around the aerosol. This is also advantageous for a rapid and economical change of the printing medium (liquid or paste from the capillary) due to a capillary replacement during a printing process, as well as for a significant reduction in the probability of malfunction due to ongoing deposits of printing medium in the outlet opening and the prechamber, progressing to complete clogging. Since the aerosol is preferably focused by the guide gas flow and/or by electric fields immediately after exiting the capillary, other parts of the print head, in particular of the focusing nozzle, are not contaminated. This makes it possible to use one and the same print head for different printing media (pastes, liquids, e.g., fluids, inks) without risking any cross-contamination between these printing media. This is of particular interest for a preferred use of the print head and/or of the printing method for the creation of printed electronics (strip conductors, components, etc.) or for biological or chemically active coatings.

Various embodiments of the print head and method described herein have been tested in various. Both clamping and adhesive connections between a piezo element and a glass capillary have already been successfully tested. In doing so, the following three modes of aerosol production were used:

- Stable, very strong and very thin aerosol jet from the glass capillary. The jet direction appears to be determined by unevennesses of functional patterns of the glass capillaries. The drop size is less than 1 μm.
- Broad, bell-shaped aerosol mist at the outlet of the glass capillary. The drop size is larger than in the aerosol jet described above.
- Stable, very strong and very thin aerosol jets which emerge from the capillary tip at 90° to the capillary axis. The jet direction appears to be determined by unevennesses of functional patterns of the glass capillaries. The drop size is less than 1 μm.

FIGS. 1*a* and *b* schematically show a print head in two embodiments of the print head. Key components of the print head are the print head housing 1 with an outlet opening 2 as well as the axially movable capillary 4 with a nozzle opening 5 suspended concentrically around an axis of symmetry 3 or, in the case of a flat nozzle, a plane of symmetry 6 in said outlet opening. A prechamber 8 is arranged in the print head housing 1 between nozzle opening 5 and outlet opening 2. The capillary 4 is suspended in the housing by means of at least one elastic element 7 and guided axially along the axis of symmetry or plane of symmetry. In the embodiment shown, the capillary 4 is fixed in a separate receptacle 9, preferably furnished with clamping means. The capillary cannot rotate or tilt or can only do so under high forces. The elastic flexibility of the suspension of the capillary thus formed is substantially higher in the axial direction than in the direction orthogonal to the aforementioned axis of symmetry or plane of symmetry. At least one of the elastic elements is additionally connected to or forms a structural unit with an actuator 10 (FIG. 1*a*). For example, the elastic element can be formed by the actuator (FIG. 1*b*) for this purpose.

Furthermore, the print head housing 1 has at least one inlet opening 11 for a guide gas and a feed means 12 for the liquid to be printed. The flow curves for the guide gas 13 and for the liquid 14 to be printed are indicated in FIGS. 1*a* and *b*. The inlet openings are arranged, as shown in the example, preferably laterally around the capillary 4 and proximally to the nozzle opening 5 in order to form a sheath flow in the prechamber. The suspension of the capillary in the print head, comprising the aforementioned elastic elements and the actuator, must, provided they are arranged distally to the inlet openings 11, permit axial flow around or through them, i.e., may be provided with recesses which permit axial flow through them.

The inlet openings 11 shown in FIG. 1*a* lead laterally into the print head housing. The connections of the inlet openings are thus arranged laterally, with the result that a larger proximal cover region 15 located above the inlet openings is available for embodiments in order to allow better replaceability of the capillary, including the feed means 12. Any dead volumes 16 through which the guide gas does not flow can be structurally minimized in general and in particular in the aforementioned cover region by an appropriate design of the print head housing 1 or by components (e.g., a cover closure system) which are not shown. In principle, the print head housing 1 can be disassembled or opened by an embodiment which is not shown further, e.g. in order to replace the capillary. The cover region 15 is preferably removable from the rest of the print head housing while the print head housing is held, for example, by means of its outside surfaces.

Figure 1B:
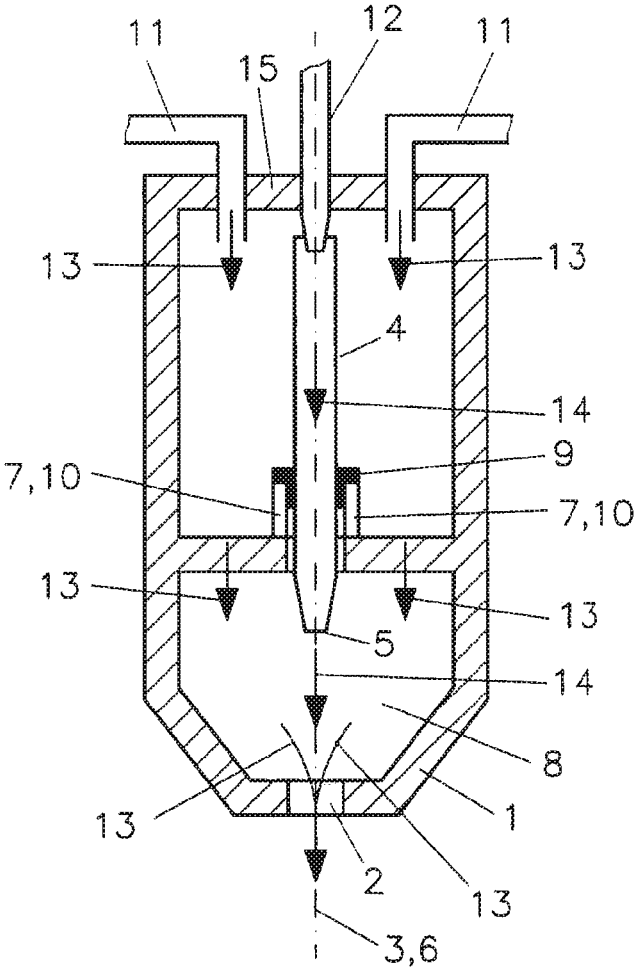

FIG. 1*b*, on the other hand, shows an exemplary embodiment in which the inlet openings 11 are arranged in the proximal cover region 15 in the immediate vicinity of the feed means 12. The inlet openings are thus no longer arranged on the outside surface of the print head housing, as shown in FIG. 1*a*, with the result that the outside surface is advantageously available for handling the print head housing in a printing device, i.e., can also be clamped and replaced more universally. Furthermore, this arrangement supports a slimmer design of the print head housing which e.g. allows for a narrower arrangement of a plurality of print head housings and also a magazine thereof. The print head housing as such can also be moved and aligned better in a printing device or by means of a manipulator when the connections are bundled, i.e., are combined into a connecting cable, which is made easier by the aforementioned close arrangement of the inlet openings 11 in the proximal cover region 15 in the immediate vicinity of the feed means. This arrangement is also advantageous if the connections of the inlet openings and the feed means must be changed together, e.g. when the capillary is replaced, e.g. if the guide gas and the liquid to be printed must be matched to one another for a chemical reaction. Additionally, the connections can be designed more compactly and the print head housing 1 is thus easier to grip, which in turn greatly benefits the integration of the print head as a whole into a manipulator or robotic system.

Said suspension for the capillary in the print head housing comprises at least one elastic element, at least one actuator, preferably also a separate receptacle for the capillary. The receptacle further preferably comprises clamping means for force-fitting fixing in place of the capillary. Optionally, the capillary has on its outer surface at least one three-dimensional surface structure which can be form-fittingly held by the receptacle by means of a negative structure at least partially matching this surface structure.

FIGS. 2*a* to *e* show by way of example in detail various embodiments of the suspension of the capillary in the print head housing with translation actuators (a) to (c), bending actuators (d) and shear actuators (e) in which the function of the actuator and the elastic element are combined.

Figure 2A:
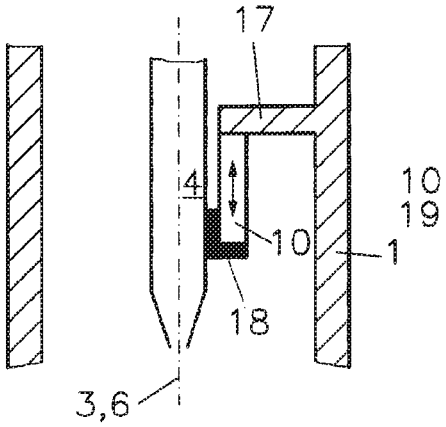
FIGS. 2*a* to 2*e* show a schematic detail view of various embodiments of the suspension of the capillary in the print head housing with translation actuators (a) to (c), bending actuators (d) and shear actuators (e) which combine the function of the actuator and the elastic element.

FIG. 2*a* shows an embodiment with a one-sided translation actuator, for example a piezoelectric actuator of type d31 (transverse actuator) or type d33 (longitudinal actuator, monolayer or multilayer construction) attached to a projection 17 on the inner wall of the print head housing and acting against a capillary receiving element 18. The one-sided arrangement of the actuator shown is suitable only for guided actuator movements in the non-resonant frequency range. However, one embodiment provides for two or more identical actuators of these aforementioned translation actuators to be arranged on both sides of a capillary and/or at a regular distance from one another circumferentially with respect to a capillary which in this case is rotationally symmetric and to be operated synchronously, thus producing axial symmetry around the capillary and thus also enabling resonance mode.

Figure 2B:
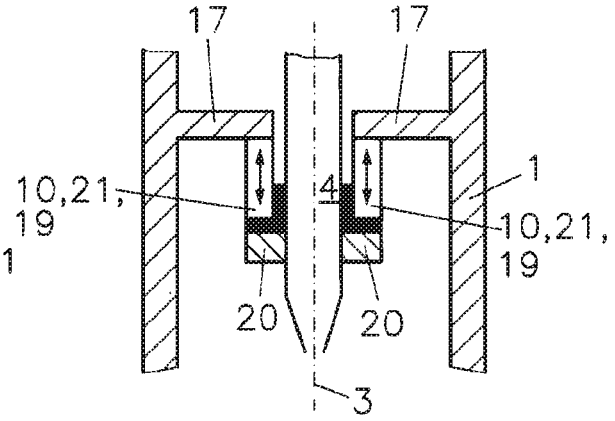
Figure 2C:
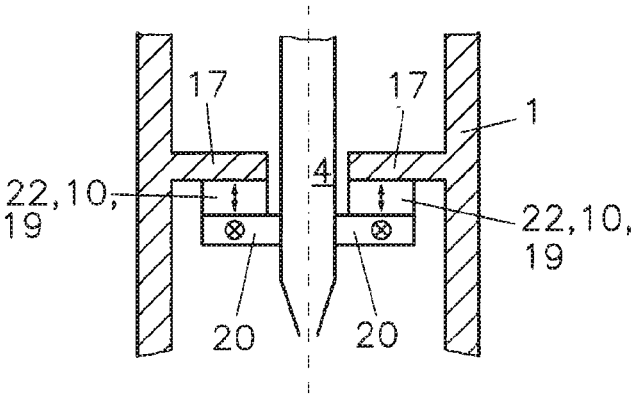

FIGS. 2*b* and *c* show embodiments with an annular translation actuator 19 running around the capillary, designed e.g. as a piezoelectric d31 actuator 21 (see FIG. 2*b*) or d33 actuator 22 (see FIG. 2*c*), which is well suited for resonant oscillating movements due to its symmetry around the capillary. The basic structure is similar to that shown in FIG. 2*a*; the capillary receiving element has an additional oscillating mass 20 which influences the resonance frequency and is arranged annularly around the capillary. As indicated in FIG. 2*c*, the oscillating mass can be designed to be two-part, wherein the capillary can in principle be clamped between the two parts in a force-fitting or form-fitting connection.

Figure 2D:
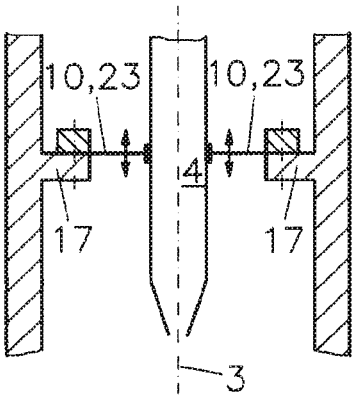

FIG. 2*d* shows a suspension with oscillating bending actuators, preferably multilayer piezoelectric d31 actuators with opposite polarity or a d31 actuator attached to a bending element, which are preferably mounted on the inner wall of the print head housing and engage on the surface of the capillary at the other end. FIG. 2*d* shows by way of example an embodiment with two strip-shaped oscillating bending actuators arranged mirror-symmetrically on a plane to the capillaries. For a more stable arrangement which allows only axial movements of the capillary, it is advantageous to provide this arrangement on the capillary a second time in parallel to the other.

Figure 2E:
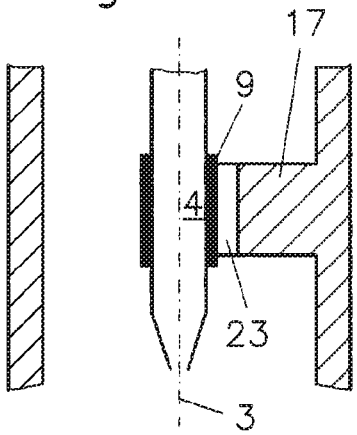

FIG. 2*e* shows by way of example an embodiment in which the actuator is designed as an oscillating shear actuator 23, for example a piezoelectric d15 transducer. It is fixed (e.g. glued) laterally to the capillaries 4 or, as shown, to the separate receptacle 9 for the capillary 4. On the other side, it is fixed on a projection 17 on the side of the print head housing. An embodiment with a single oscillating shear actuator is shown, wherein further embodiments with two or more such actuators are conceivable, which are further preferably arranged evenly, i.e., at a uniform angle to one another around the capillary.

The capillary can be suspended in the print head housing, for example, using coupling gear arrangements with flexure or conventional hinges in such a way that one primarily produces a translation in the capillary direction and the parasitic translation perpendicular to the capillary direction is suppressed or compensated for as much as possible and the capillary also oscillates in a torque-free manner as much as possible. FIGS. 3*a* to *e* disclose exemplary embodiments of the suspension of the capillary in the print head housing with separate elastic elements 28 and separate actuators 10. The suspensions are always designed so that the capillaries 4 inserted in the elastic elements 28 can always move axially, i.e., in the direction of the axis of symmetry 3, and the movement can be induced by the actuators 10. As shown in the embodiments shown, the actuators 10 preferably act directly on the elastic elements 28, deform them, and thus induce the aforementioned axial displacement of the capillary 4. The elastic elements preferably extend around the capillary rotationally symmetrically or identically and at equal angular distances from one another. The elastic elements 28 in turn have elastic flexure hinges 29 or elastic bending strips 31.

Figure 3A:
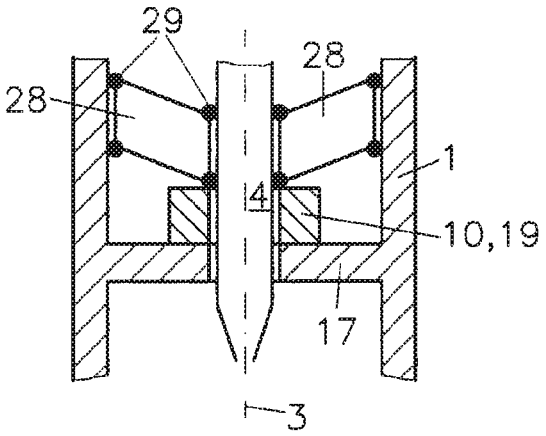
FIGS. 3*a* to 3*e* show schematic representations of various embodiments of the suspension of the capillary in the print head housing with separate elastic elements and separate actuators.
Figure 3B:
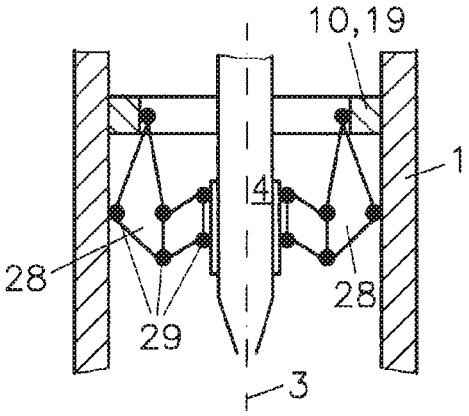
Figure 3C:
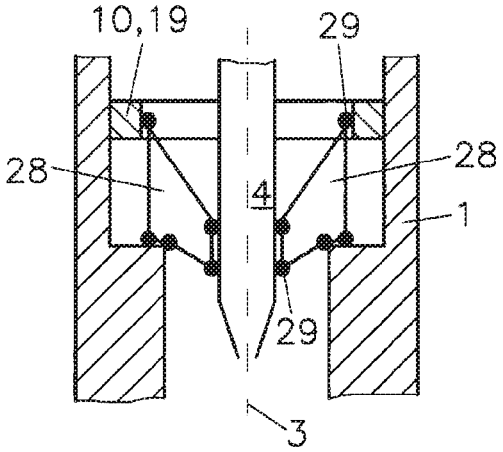

One group of embodiments is represented by FIGS. 3*a* to *c*. In each case, these embodiments provide for at least two identically designed elastic elements 28 which are oriented toward the capillary 4 and which are preferably designed as a lattice, the lattice elements being connected to one another and preferably designed to be pivotable against one another around an axis by hinges, preferably the aforementioned elastic flexure hinges 29. The actuators 10 are preferably piezoelectric ring actuators (e.g., annular translation actuator 19) or individual actuators arranged in each case around the capillary together with the elastic elements.

FIG. 3*a* shows an embodiment with an actuator acting axially with respect to the capillary and arranged on a projection 17 around the capillary, preferably an annular d31 actuator. Said actuator preferably acts axially on, in each case, a first flexure hinge of the elastic elements which are configured as a parallelogram guide having four lattice elements each and are fixedly inserted into the print head housing 1 via a lattice element having in each case two elastic flexure hinges 29 on one side and are connected to the capillary which is axially movable in the print head housing via another lattice element arranged opposite the first and having two other elastic flexure hinges 29.

FIG. 3*b* shows a further embodiment of a suspension of the capillary with elastic elements, each of which comprises a series arrangement of a parallelogram guide and a further quadrangular lattice with four lattice elements. FIG. 3*c* shows an embodiment of an elastic element with five elastic flexure hinges, wherein in each case two of these flexure hinges are arranged in axial order on the capillary or in radial order on a projection on the inner wall of the print head housing, and the fifth flexure hinge is in turn controllable and movable radially with respect to the capillary by the actuator. In both of the aforementioned embodiments, the annular translation actuator 19 is fixedly inserted into the print head housing 1 and oriented radially with respect to the capillary in its stroke orientation. FIGS. 3*b* and *c* thus represent exemplary embodiments in which radial positioning movements are redirected into axial capillary movements by an actuator.

Figure 3D:
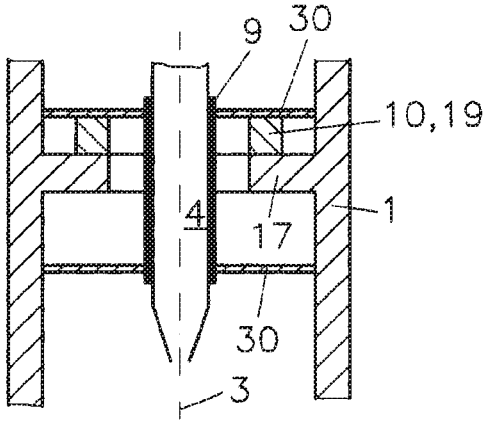

FIG. 3*d* represents an exemplary embodiment in which the capillary 4 is axially inserted and guided in the print head housing in a manner that is axially movable by two preferably rotationally symmetric and/or pretensioned plate spring elements 30 which form the elastic elements. One of these plate spring elements is pretensioned and deflected axially to the capillary by a ring actuator, preferably an annular d31 actuator, with the ring actuator being arranged on a projection 17 around the capillary as described in FIG. 3*a*.

Figure 3E:
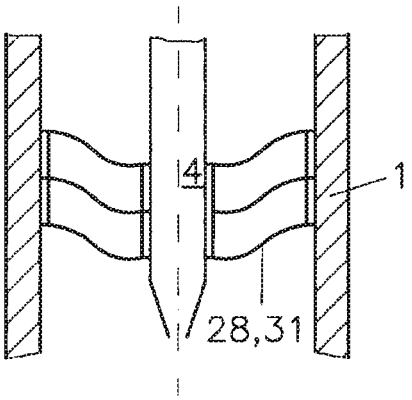

FIG. 3*e* shows another exemplary embodiment in which the capillary 4 is axially inserted and guided in the print head housing in a manner that is axially movable by three elastic bending strips 31 (alternatively bending sheet elements)

which form the elastic elements. In the example, two of the bending strips preferably serve only for parallel guidance of the capillary, while at least one third bending strip is preferably designed as an actuator or can be controlled by an actuator to trigger a capillary movement. At least one of these bending strips is preferably coated with a piezoelectric material and with said material forms a bimorph bending actuator by which the capillary can be axially moved.

The aforementioned embodiments, in particular the receptacles 9 illustrated in FIGS. 1*a* and *b* and FIGS. 2*a* to *e*, preferably comprise clamping means for the capillary 4 which enable the capillary to be pulled out axially in the proximal direction, i.e., away from the outlet opening. The clamping means are preferably formed by a slotted tube element pretensioned around the capillary, alternatively by spring-loaded inserts in the tube, two opposing clamping elements for the capillary or by an elastic element with a bore for the capillary dimensioned as a press fit.

Figure 4:
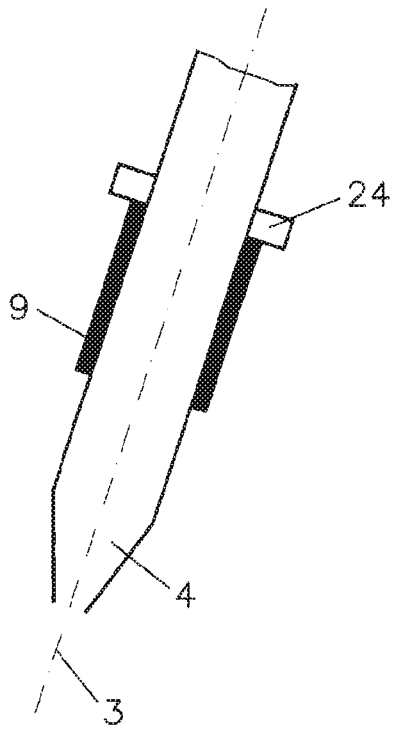
FIG. 4 shows a schematic arrangement of a capillary with collar in a receptacle.

FIG. 4 shows an exemplary arrangement of a capillary 4 in a receptacle 9, wherein the capillary shown has a collar 24 (preferably an elevation on the capillary or a ring fixed on the capillary) acting as a stop to allow precise adjustment. This makes it possible to insert the capillary in a reproducible position into the receptacle. One embodiment provides a tubular casing, with or without the aforementioned collar, which is additionally fixed to the capillary and mechanically protects it and with which the receptacle engages.

Figure 5A:
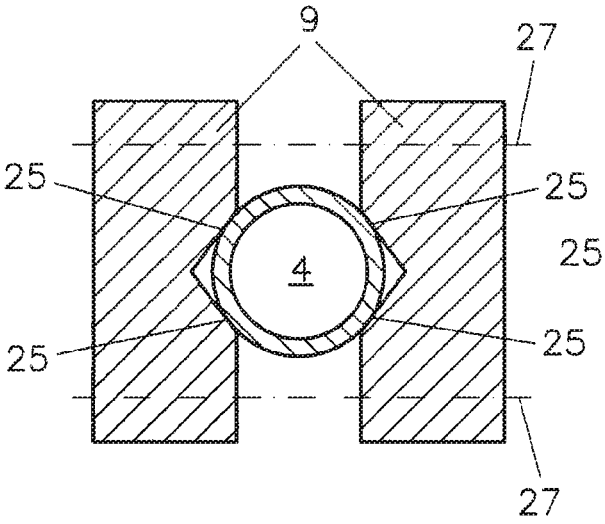
FIGS. 5*a* to 5*d* show a basic sectional representation of a possible arrangement of a capillary in a receptacle designed with clamping means.
Figure 5B:
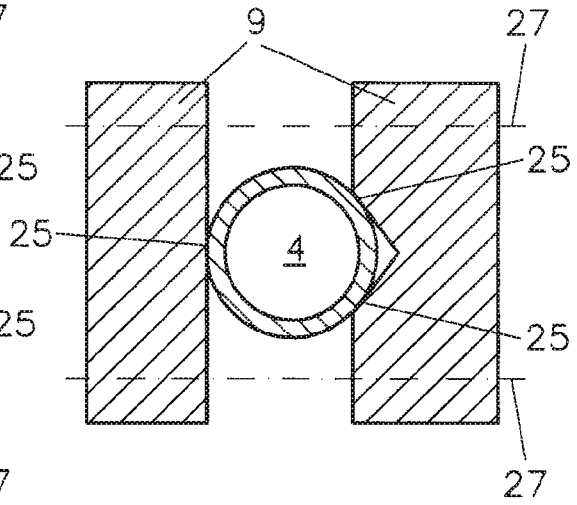
Figure 5C:
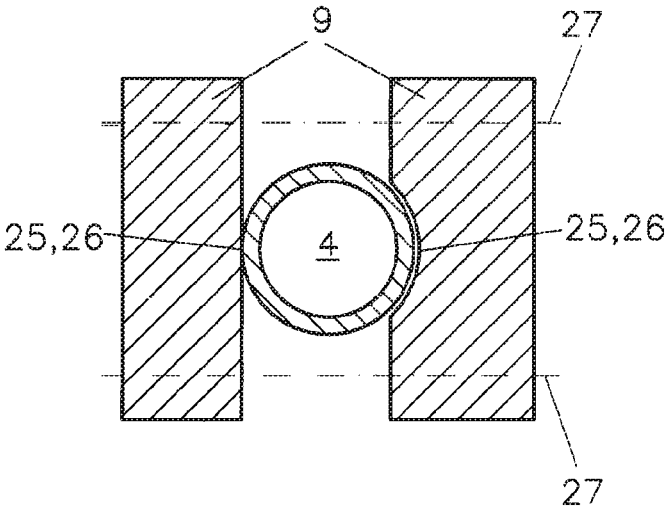
Figure 5D:
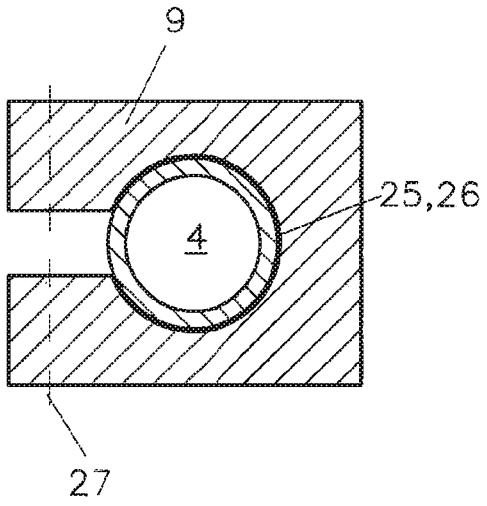

FIGS. 5*a* to *d* show a schematic sectional view of possible arrangement of a capillary 4 in a receptacle 9 formed with clamping means, FIGS. 5*a* and *b* each show an embodiment having four or three contact lines 25 respectively, FIG. 5*c* an embodiment having a contact line 25 and a contact surface 26, and FIG. 5*d* an embodiment having only a contact surface 26. The pretensioning is applied, as shown, by elastic tie rods 27, e.g. in an adjustable manner by means of elastic expansion screws. Further combinations, e.g. embodiments with two opposing contact surfaces or with elastic intermediate elements (e.g., made of elastomers) are expressly also named. Clamping via contact surfaces is gentler than clamping via contact lines, especially for capillaries made of brittle materials, such as glass, but requires more exact and thus also more elaborate matching of the contact surfaces in order to avoid stress singularities in the capillary.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Print head housing
2 Outlet opening
3 Axis of symmetry
4 Capillary
5 Nozzle opening
6 Plane of symmetry
7 Elastic element
8 Prechamber
9 Separate receptacle
10 Actuator
11 Inlet opening
12 Feed means
13 Guide gas
14 Liquid to be printed
15 Proximal cover region
16 Dead volume
17 Projection
18 Capillary receiving element
19 Annular translation actuator
20 Oscillating mass
21 d31 actuator
22 d33 actuator
23 Oscillating shear actuator
24 Collar
25 Contact line
26 Contact surface
27 Elastic tie rod
28 Elastic element
29 Elastic flexure hinge
30 Plate spring element
31 Elastic bending strips

The invention claimed is:

1. A print head comprising:

a capillary around an axis of symmetry for a liquid to be printed on a substrate, the capillary adjoining at least one elastic element and having a nozzle opening which opens into a prechamber, wherein:

a) the prechamber has an outlet opening aligned with the nozzle opening of the capillary in its axial orientation of the axis of symmetry and at least one inlet opening for a guide gas, b) the at least one elastic element forms a guide for the capillary in its axial orientation only, c) a feed for the liquid to be printed is provided in the capillary, d) a mechanical oscillation system is provided that includes the at least one elastic element and the capillary with the liquid contained therein, and e) a piezo actuator configured to interact, via a mechanical force, with the oscillation system is provided.

2. The print head according to claim 1, wherein the at least one elastic element is formed by at least one coupling gear arrangement with flexure or conventional hinges.

3. The print head according to claim 1, wherein a plurality of elastic elements are provided which are of the same design and are oriented around and toward the capillary.

4. The print head according to claim 1, wherein the at least one elastic element is designed as a lattice having a plurality of lattice elements, wherein the lattice elements are connected to one another and configured to be pivotable against one another around an axis by hinges.

5. The print head according to claim 1, wherein at least one of the at least one elastic element is formed by a plate-shaped or bar-shaped elastic element.

6. The print head according to claim 1, wherein at least one of the at least one elastic element is formed by the actuator.

7. The print head according to claim 6, wherein the actuator is formed by a plate-shaped or bar-shaped bending actuator, and wherein a receptacle for the capillary is arranged in a center of the bending actuator.

8. The print head according to claim 7, wherein the receptacle comprises at least one clamp for receiving the capillary.

9. The print head according to claim 8, wherein the at least one clamp is part of an oscillatable mass on the at least one elastic element.

10. The print head according to claim 1, wherein the outlet opening, the prechamber and/or the at least one elastic element have a rotationally symmetric extent around the axis of symmetry of the capillary.

11. The print head according to claim 1, wherein the outlet opening is configured to generate an electrostatic field orthogonal to the axis of symmetry.

12. The print head according to claim 11, wherein the outlet opening includes electrodes in or around the outlet opening and/or as electrically conductive regions in or under the substrate.

13. The print head according to claim 1, characterized in that at least one ring electrode and/or at least one pneumatic lens is arranged around the outlet opening and/or the outlet opening is designed as a ring electrode.

14. The print head according to claim 1, wherein the piezo actuator has a receptacle for the capillary via which the piezo actuator can clamp the capillary in a force-fitting manner.

15. A printing method for printing a structure onto a substrate using a print head, the method comprising:

a) conducting a liquid through a capillary through a nozzle opening into a prechamber, wherein the nozzle opening is moved back and forth in the axial direction of the capillary by a mechanical oscillation system, wherein the oscillation system is excited by a piezo actuator in a resonance oscillation, wherein the liquid is continuously separated out and atomized as fluid droplets at the nozzle opening, b) introducing a guide gas into the prechamber around the capillary through the at least one inlet opening, wherein a first portion of the guide gas forms an aerosol flow with the fluid droplets in the prechamber and a second portion forms a sheath flow around the aerosol flow between the nozzle opening and the outlet opening, c) conducting the aerosol flow surrounded by the sheath flow out of the prechamber through the outlet opening onto a surface of a substrate, and d) applying the fluid droplets to the surface.

16. The printing method according to claim 15, wherein the aerosol flow is focused in the prechamber or out of the prechamber.

17. The printing method according to claim 15, wherein the aerosol flow is electrostatically deflected, focused or further atomized when passing through the outlet opening.

18. The printing method according to claim 15, wherein a speed of the ongoing separation and atomization of the liquid at the nozzle opening can be regulated by the amplitude, frequency, and/or signal form of the oscillation.

19. A print head comprising:

a capillary around an axis of symmetry for a liquid to be printed, the capillary adjoining at least one elastic element and having a nozzle opening which opens into a prechamber, wherein:

a) the prechamber has an outlet opening aligned with the nozzle opening of the capillary in its axial orientation of the axis of symmetry and at least one inlet opening for a guide gas, b) the at least one elastic element forms a guide for the capillary in its axial orientation only, wherein the at least one elastic element is formed by at least one coupling gear arrangement with flexure or conventional hinges c) a feed for the liquid to be printed is provided in the capillary, d) a mechanical oscillation system is provided that includes the at least one elastic element and the capillary with the liquid contained therein, and e) an actuator with a mechanical or magnetic force interaction with the oscillation system is provided.

20. The print head according to claim 19, wherein a plurality of elastic elements are provided which are of the same design and are oriented around and toward the capillary.

* * * * *